US009726178B2

(12) United States Patent
Fournier et al.

(10) Patent No.: US 9,726,178 B2
(45) Date of Patent: Aug. 8, 2017

(54) MECHANICAL COOLANT PUMP

(75) Inventors: Arnaud Fournier, Yutz (FR); Pascal Georges, Thionville (FR); Gilles Simon, Montois la Montagne (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 348 days.

(21) Appl. No.: 14/373,633

(22) PCT Filed: May 31, 2012

(86) PCT No.: PCT/EP2012/060275

§ 371 (c)(1),
(2), (4) Date: Jul. 22, 2014

(87) PCT Pub. No.: WO2013/120542

PCT Pub. Date: Aug. 22, 2013

(65) Prior Publication Data

US 2015/0016967 A1 Jan. 15, 2015

(30) Foreign Application Priority Data

Feb. 14, 2012 (WO) ..... PCT/EP2012/052525

(51) Int. Cl.
*F04D 1/04* (2006.01)
*F04D 1/00* (2006.01)
(Continued)

(52) U.S. Cl.
CPC ..... *F04D 1/04* (2013.01); *F01P 5/10* (2013.01); *F01P 7/16* (2013.01); *F01P 11/00* (2013.01);
(Continued)

(58) Field of Classification Search
CPC ..... F04D 1/00; F04D 1/04; F04D 15/0005; F04D 15/0022; F04D 29/46;
(Continued)

(56) References Cited

U.S. PATENT DOCUMENTS 4,709,666 A 12/1987 Merz
4,863,144 A * 9/1989 Wilson ..... F16K 27/065 251/298
(Continued)

FOREIGN PATENT DOCUMENTS

CN 102022174 A 4/2011
EP 2 299 084 A1 3/2011
(Continued)

*Primary Examiner* — Craig Kim
*Assistant Examiner* — Brian P Wolcott
(74) *Attorney, Agent, or Firm* — Norman B. Thot

(57) ABSTRACT

A coolant pump includes an impeller pump wheel, a pump housing defining an outlet volute, and an outlet valve arrangement. The pump housing comprises an outlet volute housing which defines a first outlet channel comprising a valve opening. The valve opening is defined by a valve seat which defines a valve seat plane and a symmetry plane. The symmetry plane is arranged in the middle of and rectangular to the valve seat plane. The outlet valve arrangement is in the first outlet channel and comprises a valve flap which opens/closes the valve opening. The valve flap comprises a flap seat corresponding to the valve seat. The valve flap rotates around a pivot axis parallel to the symmetry plane and having an eccentricity from the symmetry plane which is between 1/20 and 1/1 of a distance of the pivot axis to the valve seat plane when the valve flap is open.

7 Claims, 5 Drawing Sheets

(51) Int. Cl.

| | |
|---|---|
| ***F04D 15/00*** | (2006.01) |
| ***F01P 11/00*** | (2006.01) |
| ***F01P 5/10*** | (2006.01) |
| ***F01P 7/16*** | (2006.01) |

(52) U.S. Cl.
CPC ..... *F04D 1/00* (2013.01); *F04D 15/0005* (2013.01); *F04D 15/0022* (2013.01)

(58) Field of Classification Search
CPC ..... F04D 29/466; F04D 29/468; F01P 5/10; F01P 7/16; F01P 11/00; F01P 2007/146
USPC ..... 137/625.29, 625.46, 625.47
See application file for complete search history.

(56) References Cited

U.S. PATENT DOCUMENTS

| | | | | |
|---|---|---|---|---|
| 5,095,855 | A | 3/1992 | Fukuda et al. | |
| 2002/0179165 | A1 | 12/2002 | Hu et al. | |
| 2007/0235679 | A1* | 10/2007 | Sutliff | F16K 1/2007 251/317.01 |
| 2009/0183697 | A1 | 7/2009 | Inui | |
| 2012/0076637 | A1 | 3/2012 | Hoji | |
| 2012/0192816 | A1 | 8/2012 | Simon et al. | |
| 2013/0011250 | A1 | 1/2013 | Fournier et al. | |

FOREIGN PATENT DOCUMENTS

| | | | | |
|---|---|---|---|---|
| FR | 2 719 100 | A1 | 10/1995 | |
| JP | 48-104103 | A | 2/1972 | |
| JP | 58-81273 | A | 5/1983 | |
| JP | 61-52469 | A | 3/1986 | |
| JP | 3-222814 | A | 10/1991 | |
| JP | 4-237898 | A | 8/1992 | |
| JP | 10-77837 | A | 3/1998 | |
| JP | 11-2126 | A | 1/1999 | |
| JP | 2005-54997 | A | 3/2005 | |
| JP | 2007-303435 | A | 11/2007 | |
| JP | 2011-7055 | A | 1/2011 | |
| WO | WO 2010/146609 | A1 | 12/2010 | |
| WO | WO 2010/150379 | A1 | 12/2010 | |
| WO | WO 2011/095907 | A1 | 8/2011 | |
| WO | WO 2011/101019 | A1 | 8/2011 | |
| WO | WO 2011095907 | A1 * | 8/2011 | F01P 5/12 |
| WO | WO 2011/154852 | A1 | 12/2011 | |

* cited by examiner

MECHANICAL COOLANT PUMP

CROSS REFERENCE TO PRIOR APPLICATIONS

This application is a U.S. National Phase application under 35 U.S.C. §371 of International Application No. PCT/EP2012/060275, filed on May 31, 2012 and which claims benefit to International Patent Application No. PCT/EP2012/052525, filed on Feb. 14, 2012. The International Application was published in English on Aug. 22, 2013 as WO 2013/120542 A1 under PCT Article 21(2).

FIELD

The present invention relates to a mechanical coolant pump for an internal combustion engine. A mechanical coolant pump is driven by the combustion engine, for example, by using a driving belt driving a driving wheel of the pump, so that the rotational speed of the coolant pump is proportional to the rotational speed of the combustion engine. Only a minimum coolant flow is needed as long as the combustion engine is cold. Mechanical coolant pumps are therefore provided with an outlet valve arrangement to control the coolant flow leaving the coolant pump. As long as the combustion engine is cold, the outlet valve is closed so that the circulation of the lubricant is reduced, minimized or completely stopped, with the result that the combustion engine warming-up phase is shortened.

BACKGROUND

WO 2011/101019 A1 describes an impeller-type coolant pump with an outlet valve arrangement in the root of an outlet channel. The outlet valve arrangement is provided with a valve flap whereby the pivot axis of the valve flap is arranged at one end of the flap body and is provided in the surface plane of the valve seat. The valve flap should be pivotable even at high rotational speeds of the pump rotor at which a high fluid pressure against the valve flap either in a closing direction or in an opening direction can occur. High actuation power is needed, however, to provide full functionality at all rotational speeds.

SUMMARY

An aspect of the present invention is to provide a mechanical coolant pump for an internal combustion engine with an outlet valve arrangement for relatively low actuation forces with good long-term tightness of the closed outlet valve.

In an embodiment, the present invention provide a mechanical coolant pump for an internal combustion engine which includes an outlet volute, an impeller pump wheel configured to pump an incoming liquid coolant in an axial direction radially into the outlet volute, a pump housing, and an outlet valve arrangement. The pump housing comprises an outlet volute housing which defines a first outlet channel comprising a valve opening. The pump housing is configured to define the outlet volute. The valve opening is defined by and surrounded by a valve seat which defines a valve seat plane and a symmetry plane. The symmetry plane is arranged in the middle of and rectangular to the valve seat plane. The outlet valve arrangement is arranged in the first outlet channel. The outlet valve arrangement comprises a valve flap configured to pivot between an open position and a closed position so as to open or close the valve opening of the first outlet channel. The valve flap comprises a flap seat configured to correspond to the valve seat. The valve flap is configured to rotate around a pivot axis which is parallel to the symmetry plane and which is arranged so as to have a lateral eccentricity from the symmetry plane. The lateral eccentricity is between 1/20 and 1/1 of a distance of the pivot axis to the valve seat plane when the valve flap is in the open position.

BRIEF DESCRIPTION OF THE DRAWINGS

The present invention is described in greater detail below on the basis of embodiments and of the drawings in which.

DETAILED DESCRIPTION

Figure 1:
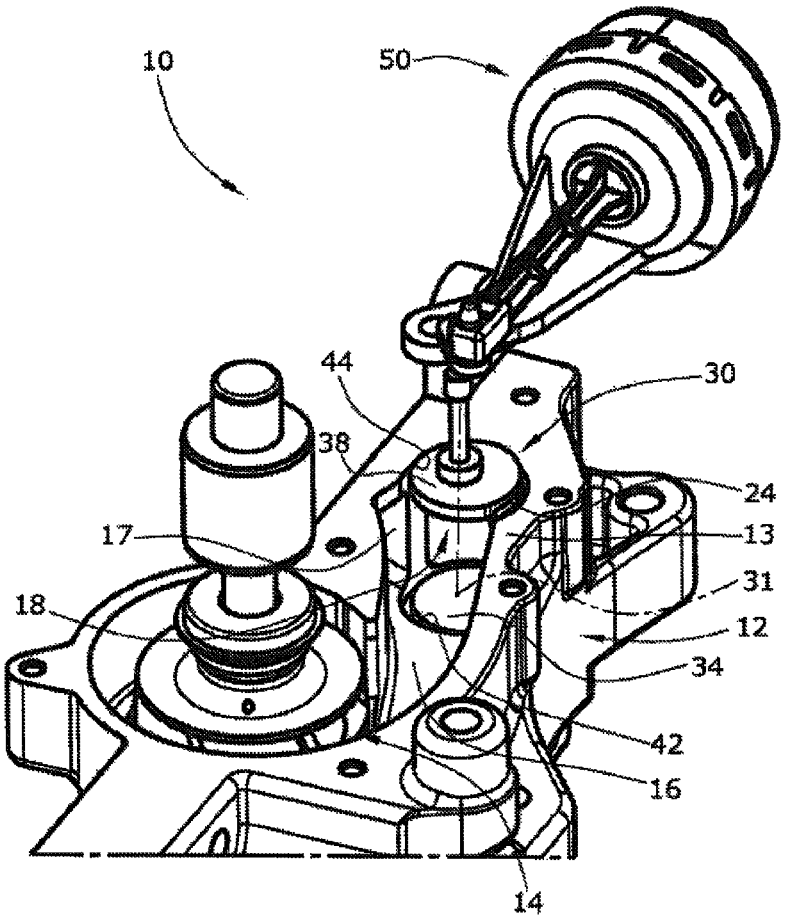
FIG. 1 shows a perspective view of a mechanical coolant pump without a housing cover with a valve flap in the open position.

In an embodiment of the present invention, the mechanical coolant pump is provided with an impeller pump wheel pumping the liquid coolant incoming in an axial direction radially outwardly into an outlet volute. The outlet volute continues into an outlet channel of the pump. An outlet valve arrangement is provided in the course of the outlet channel, whereby the outlet valve arrangement comprises a valve flap being movable between an open position and a closed position so as to open or close the valve opening of the outlet channel.

The valve opening of the outlet channel is defined by and surrounded by a valve seat. The valve seat is a closed contact line of the valve opening and the corresponding flap seat of the valve flap in the closed valve position. The valve seat defines a general valve seat plane. If the valve seat does not completely lie in one single plane because some portions of the valve seat are somehow curved, then the valve seat plane is defined by a general geometric middle plane. A symmetry plane is provided in the middle of the valve opening and of the valve seat plane. The symmetry plane is exactly rectangular to the valve seat plane and parallel to a pivot axis of the valve flap.

The valve flap is pivotable or rotatable around the pivot axis which is parallel to the symmetry plane, however, the pivot axis is not located in the symmetry plane. The pivot axis is located with a lateral eccentricity from the symmetry plane, whereby the lateral eccentricity is between 1/20 and 1/1 of the pivot axis' distance to the valve seat plane. The valve flap can be realized as a plane body, but can also, for example, be realized as a cylindrical body. When the valve flap is rotated into its closed position, the flap seat contacts the valve seat only in the very last moment of the closing movement. During the closing movement of the valve flap, the valve seat and the flap seat are not in contact at all so that no relevant abrasion of the flap seat and of the valve seat can occur. This provides a good long-term tightness of the closed valve.

In an embodiment of the present invention, the pivot axis can, for example, lie within the projection of the valve seat so that the eccentricity is less than half of the width of the valve seat projection. The lateral eccentricity does not exceed ½ of the valve flap width when the flaps extend in a direction rectangular to the pivot axis. The arrangement of the pivot axis within the projection of the valve seat provides that the actuation forces for opening and closing the valve flap are relatively low even at high rotational speeds of the pump wheel generating a relatively high outlet pressure of the liquid coolant.

In an embodiment of the present invention, at least one axial end of the valve flap can, for example, be fixed to a base disc which is arranged rectangular to the pivot axis. In an embodiment, two base disks can, for example, be provided at both axial ends of the valve flap. The base disc is provided in a corresponding recess of the pump housing so that the proximal surface of the base disk lies in the plane of the inner wall surface of the outlet channel. In other words, the base disk extends the surface of the volute housing continuously, especially in the open position of the valve flap. The base disk can, in part, be circular with respect to the pivot axis so that the inner surface of the outlet channel is stepless.

In an embodiment of the present invention, the volute housing can, for example, be provided with a recess for housing the valve flap in its open position. In the open valve position, the valve flap is substantially housed in the recess so that the valve flap does not project substantially into the outlet volute or into the outlet channel. The flow resistance caused by the valve flap is therefore reduced to a minimum.

In an embodiment of the present invention, the valve flap can, for example, be provided with a valve flap body and the flap seat can be coated with a rubber coating. The rubber coating of the flap seat improves the tight sealing of the closed valve flap.

In an embodiment of the present invention, the outlet volute housing can, for example, define a second outlet channel which is not affected by the outlet valve arrangement and always remains open so that a minimum coolant flow is always provided as long as the pump wheel is driven by the internal combustion engine. Internal combustion engines with high performance, for example, truck engines, in particular always need to be cooled with a minimum coolant flow rate to avoid heat pockets. A second outlet channel without a valve is absolutely fail safe with respect to a minimum coolant flow.

In an embodiment of the present invention, the flap body can, for example, be actuated by a pneumatic, an electric, or a thermostatic actuator. The needed actuation force for providing a reliable function of the valve is relatively low independent of the activation force source.

In an embodiment of the present invention, the proximal surface of the valve flap body extends the volute housing wall surface or the channel wall surface continuously in the open position of the flap body. In the open state of the flap body, the proximal flap body surface therefore continues the surface of the volute or the outlet channel smoothly and steplessly so that the flow resistance is as low as possible.

An embodiment of the present invention is described below under reference to the drawings.

FIGS. 1 to 6 show a mechanical coolant pump 10 for circulating a coolant for an internal combustion engine. The coolant pump 10 can be directly mounted to an engine block of the internal combustion engine. The coolant pump 10 is provided with a driving wheel (not shown) which can be driven by a driving belt which is directly driven by the internal combustion engine. The rotational speed of the coolant pump 10 is proportional to the rotational speed of the internal combustion engine.

The coolant pump 10 is provided with a pump housing 12 housing an impeller pump wheel 14 pumping a liquid coolant incoming in axial direction radially into an outlet volute 16. The outlet volute 16 is defined by a volute housing 13 which is a part of the pump housing 12. The axial coolant pump inlet is provided at the bottom side of the coolant pump 10 shown in FIGS. 1 and 2.

Figure 2:
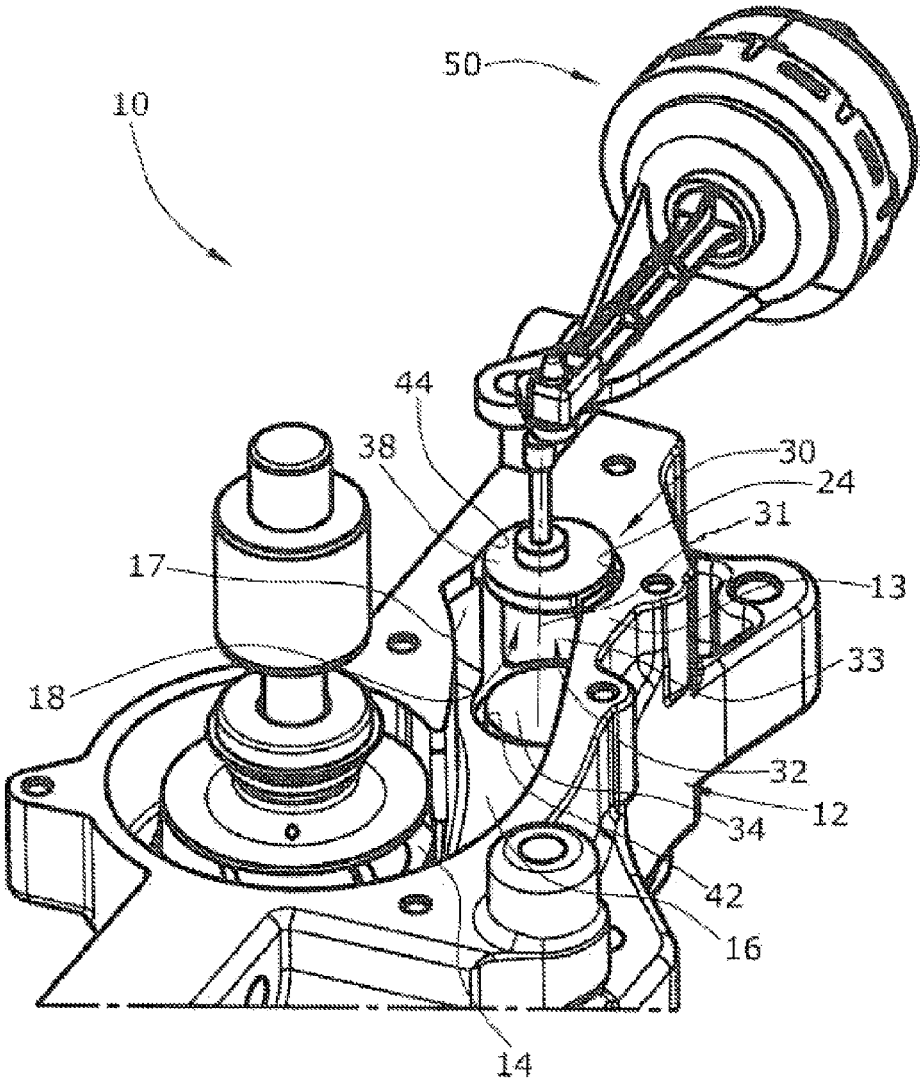
FIG. 2 shows the coolant pump of FIG. 1 with the valve flap in the closed position.

The outlet volute 16 includes a first outlet channel 18 and a second outlet channel 17 which is separated by a separating wall 20 from the first outlet channel 18. The coolant pump 10 is provided with an outlet valve arrangement at a valve opening 19 at the beginning of the first outlet channel 18. The outlet valve arrangement is provided with an integral metal valve flap 30 which is pivotable between a closed position and an open position as shown in FIGS. 1 and 2 or in FIGS. 3 and 4. The valve flap 30 closes or opens the valve opening 19 of the first outlet channel 18 but does not affect the coolant flow into and through the second outlet channel 17.

The valve flap 30 is provided with a circular flap body 32 with an axial orientation of its general valve seat plane. The flap body 32 has a proximal surface 33 and a distal surface 35. The flap body 32 is, somehow, a circumferential section of a hollow cylinder wall.

The flap body 32 is axially arranged between a first circular base disk 34 and an identical second circular base disk 38 at both axial ends of the flap body 32. The valve flap 30 is supported in pivot bearings at both axial ends so that the valve flap 30 is pivotable around an axial valve pivot axis 31 which is arranged within the outlet volute 16.

Figure 3:
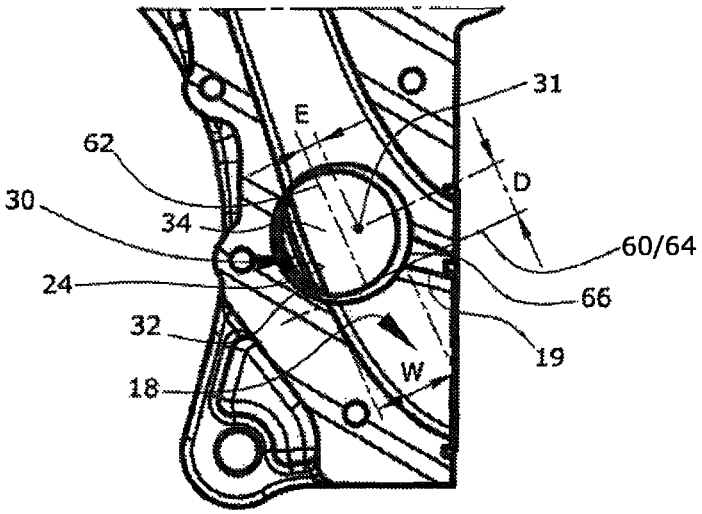
FIG. 3 shows a cross section of the valve arrangement of the coolant pump of FIG. 1 with the valve flap in the closed position.
Figure 4:
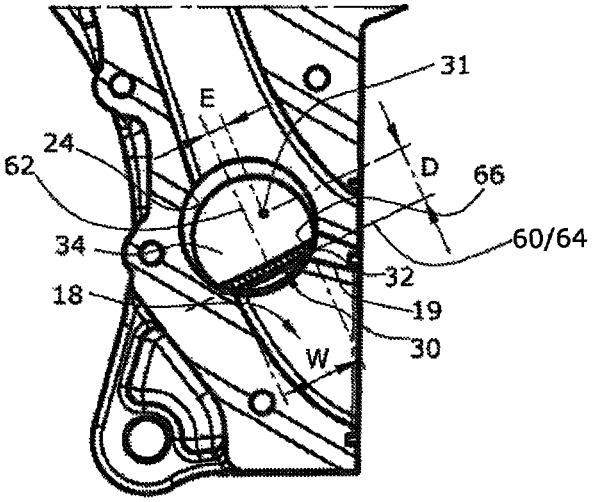
FIG. 4 shows a cross-section of the valve arrangement of the coolant pump of FIG. 1 with the valve flap in the open position.
Figure 5:
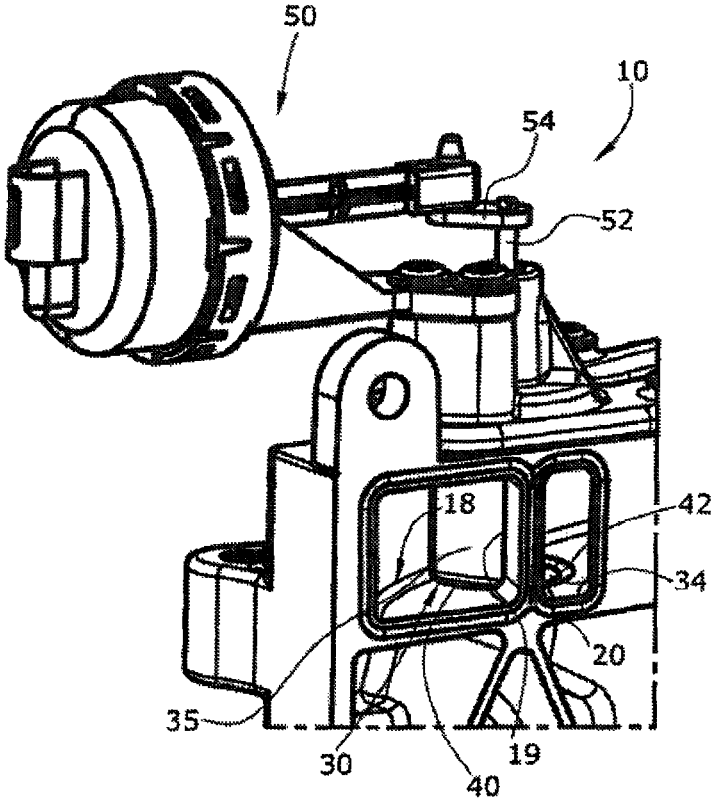
FIG. 5 shows another perspective view of the mechanical coolant pump of FIG. 1 with the valve flap in the closed position.

In the open position of the valve flap 30, as shown in FIGS. 1 and 4, the flap body 32 is housed in a volute housing recess 24 of the volute housing 13 so that the proximal surface 33 of the flap body 32 continues or extends the inside wall surface of the volute housing 13 continuously and without any relevant surface steps. As a result, the flow resistance caused by the flap body 32 in the open position is low even at high coolant flow rates. In the open position of the valve flap 30, as shown in FIG. 4, the proximal side 33 of the flap body 32 is orientated to the outlet volute 16, whereas the distal side 35 of the flap body 32 is orientated to the volute housing recess 24 recessing the flap body 32. A rubber coating 40 is provided over the entire flap seat 66 at the distal side 35 of the flap body 32. The rubber coating 40 significantly improves the sealing quality of the flap body 32 in the closed valve position, as shown in FIGS. 3 and 5.

Figure 6:
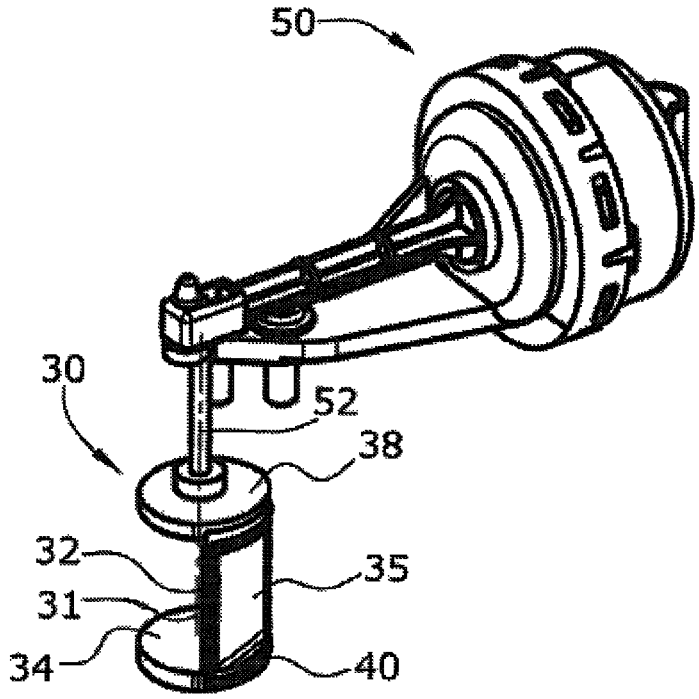
FIG. 6 shows the valve flap including an actuator of the mechanical coolant pump of FIG. 1.

The first circular base disk 34 is completely recessed in a corresponding first circular base disk housing recess 42 of the volute housing 13, and the second circular base disk 38 is completely recessed in a corresponding second circular base disk housing recess 44 of the volute housing 13. Both the first circular base disk 34 and the second circular base disk 38 therefore do not cause any relevant flow resistance in the open valve position even at high coolant flow rates. The valve is provided with a valve shaft 52 fixed to the second circular base disk 38. The valve shaft 52 defines the pivot axis 31. The valve shaft 52 is provided with a lever arm 54 which is actuated by a pneumatic actuator 50, as can be seen in FIGS. 5 and 6.

The geometric constitution of the valve arrangement can best be seen in FIGS. 3 and 4. The valve opening 19 is surrounded by a valve seat 64 which corresponds with a flap seat 66 of the valve flap 30. The valve seat 64 and the flap seat 66 are completely in contact with each other in the closed valve position as shown in FIG. 3. The valve seat 64 defines a valve seat plane 60 which represents the general plane 60 of the complete valve seat 64. The valve seat 64 is defined by two linear lateral seat portions which are parallel to each other and by two circular seat portions connecting the lateral portions. The diameter of the circular seat portions is almost equal to the diameter of the flap body 32. The lateral seat portions are parallel to the pivot axis 31. The valve seat 64 has a width W which is the lateral distance between the two linear lateral seat portions. A symmetry plane 62 is defined in the middle of the valve seat plane 60. The symmetry plane 62 is rectangular to the valve seat plane 60.

The pivot axis 31 of the valve flap 30 is parallel to the symmetry plane 62 and to the valve seat plane 60. The pivot axis 31 is provided with a distance D to the valve seat plane. The distance D of the pivot axis 31 to the valve seat plane 60 is between ½ and 3/1 of the valve seat width W. The pivot axis 31 does not lie in the symmetry plane 62, but is provided with an eccentricity E distant from the symmetry plane 62. The eccentricity E is between 1/20 and 1/1 of the pivot axis' distance D of the valve seat plane 60. In the present case, the eccentricity E is about ⅓ of the pivot axis' distance D. This geometrical arrangement provides that the valve seat 64 and the flap seat 66 touch each other only in the closed valve position.

The present invention is not limited to embodiments described herein; reference should be had to the appended claims.

What is claimed is:

1. A mechanical coolant pump for an internal combustion engine, the mechanical coolant pump comprising:

an outlet volute;

an impeller pump wheel configured to pump an incoming liquid coolant in an axial direction radially into the outlet volute;

a pump housing comprising an outlet volute housing which defines a first outlet channel comprising a valve opening, the pump housing being configured to define the outlet volute, the valve opening being defined by and surrounded by a valve seat which defines a valve seat plane and a symmetry plane, the symmetry plane being arranged in the middle of and perpendicular to the valve seat plane;

an outlet valve arrangement arranged in the first outlet channel, the outlet valve arrangement comprising a valve flap configured to pivot between an open position and a closed position so as to open or close the valve opening of the first outlet channel; and a base disk comprising a proximal surface, wherein, the valve flap comprises at least one axial end and a flap seat configured to correspond to the valve seat, the at least one axial end of the valve flap is fixed to the base disk so that the proximal surface lies in a plane of the first outlet channel, the valve flap is configured to rotate around a pivot axis which is parallel to the symmetry plane and which is arranged so as to have a lateral eccentricity from the symmetry plane, the lateral eccentricity being between 1/20 and 1/1 of a distance of the pivot axis to the valve seat plane when the valve flap is in the open position, and the base disk is arranged so as to be perpendicular to the pivot axis.

2. The mechanical coolant pump as recited in claim 1, wherein the valve seat comprises a width, the pivot axis being configured to lie within the width so that the lateral eccentricity is less than the width.

3. The mechanical coolant pump as recited in claim 1, wherein the outlet volute housing comprises a recess configured to house the valve flap in the open position.

4. The mechanical coolant pump as recited in claim 1, wherein the valve flap further comprises a metal and is coated with a rubber coating.

5. The mechanical coolant pump as recited in claim 1, wherein the outlet volute housing further defines a second outlet channel which is configured so as not to be influenced by the outlet valve arrangement.

6. The mechanical coolant pump as recited in claim 1, further comprising an actuator configured to actuate the valve flap.

7. The mechanical coolant pump as recited in claim 6, wherein the actuator is a pneumatic actuator, an electric actuator, or a thermostatic actuator.

* * * * *